US011445290B1

(12) United States Patent
Grinker et al.

(10) Patent No.: US 11,445,290 B1
(45) Date of Patent: Sep. 13, 2022

(54) FEEDBACK ACOUSTIC NOISE CANCELLATION TUNING

(71) Applicant: Apple Inc., Cupertino, CA (US)

(72) Inventors: Scott C. Grinker, Belmont, CA (US); Vladan Bajic, San Francisco, CA (US); Brian D. Clark, San Jose, CA (US); Tom-Davy W. Saux, Los Altos, CA (US); Hanchi Chen, San Jose, CA (US)

(73) Assignee: APPLE INC., Cupertino, CA (US)

( * ) Notice: Subject to any disclaimer, the term of this patent is extended or adjusted under 35 U.S.C. 154(b) by 15 days.

(21) Appl. No.: 17/027,258

(22) Filed: Sep. 21, 2020

Related U.S. Application Data

(60) Provisional application No. 62/907,376, filed on Sep. 27, 2019.

(51) Int. Cl.
*G10K 11/178* (2006.01)
*H04R 1/10* (2006.01)

(52) U.S. Cl.
CPC ..... *H04R 1/1083* (2013.01); *G10K 11/178* (2013.01); *H04R 1/1016* (2013.01); *G10K 2210/1081* (2013.01); *H04R 2460/01* (2013.01)

(58) Field of Classification Search
CPC ..... H04R 1/1083; H04R 1/1016; H04R 2460/01; G10K 11/178; G10K 2210/1081
USPC ..... 381/71.6
See application file for complete search history.

(56) References Cited

U.S. PATENT DOCUMENTS

| | | | | |
|---|---|---|---|---|
| 10,080,080 | B2 | 9/2018 | Grinker | |
| 2012/0321103 | A1* | 12/2012 | Smailagic | H04R 1/1041 381/98 |
| 2013/0329902 | A1* | 12/2013 | Bakalos | G10K 11/17821 381/71.8 |
| 2020/0335078 | A1* | 10/2020 | Cho | G10K 11/17854 |
| 2021/0020157 | A1* | 1/2021 | Zhou | H04L 25/03159 |

* cited by examiner

*Primary Examiner* — Vivian C Chin
*Assistant Examiner* — Friedrich Fahnert
(74) *Attorney, Agent, or Firm* — Womble Bond Dickinson (US) LLP

(57) ABSTRACT

A method performed by an in-ear headphone that includes a speaker and an internal microphone. The method receives a microphone signal from the internal microphone that indicates a current sound pressure level (SPL) in an ear canal of a user. The current SPL is a result of a control leak from the in-ear headphone into an ambient environment that reduces a SPL in the ear canal between 2 dB and 25 dB at a frequency within a frequency range than if otherwise not present. The method determines an active noise cancellation (ANC) filter based on the microphone signal and generates an anti-noise signal using the ANC filter. The method drives the speaker using the anti-noise signal to reduce the current SPL in the ear canal of the user as much as 25 dB at a frequency within the frequency range.

21 Claims, 5 Drawing Sheets

FEEDBACK ACOUSTIC NOISE CANCELLATION TUNING

CROSS-REFERENCE TO RELATED APPLICATION

This application claims the benefit of and priority to U.S. Provisional Patent Application Ser. No. 62/907,376, filed Sep. 27, 2019, which is hereby incorporated by this reference in its entirety.

FIELD

An aspect of the disclosure relates to digital audio signal processing techniques for performing feedback acoustic noise cancellation to reduce in-ear sound pressure. Other aspects are also described.

BACKGROUND

Headphones come in various fit types, such as an over-ear that partially rests directly against the head and surrounds the ear, an on-ear that rests against the ear, and in-ear that at least partially fits into the ear canal. In the case where the headphone is physically designed to acoustically and passively isolate ambient noise, especially in the case of a sealed in-ear headphone, there is a pocket of air that becomes essentially trapped either entirely in a blocked ear canal or between the ear and the main sound output port of the headphone. This trapped pocket of air induces the so-called occlusion effect, where the wearer perceives a louder and unnatural version of their own voice when talking.

SUMMARY

An aspect of the disclosure is a method performed by an audio system having an in-ear headphone that uses a control leak and feedback acoustic noise cancellation (ANC) to minimize the effect of occlusion. Specifically, both the control leak and the ANC minimize the effect by reducing a sound pressure level (SPL) within the user's ear canal. For example, the control leak is a path from the in-ear headphone into an ambient environment in which the in-ear headphone is located. This path prevents the pocket of air from being trapped, and therefore reduces the SPL in the ear canal within a first SPL range at a frequency within a frequency range, then if otherwise not present. The system receives a microphone signal from an internal microphone of the in-ear headphone that indicates a current SPL in the ear canal of the user, where the current SPL is the result of the control leak having the path between the in-ear headphone and the environment. Thus, the current SPL is lower than a SPL within the user's ear if the control leak was not present or was blocked. In order to further reduce the SPL, the system applies ANC. In particular, the system determines an ANC filter based on the microphone signal and generates an anti-noise signal using the ANC filter. The system drives a speaker of the in-ear headphone using the anti-noise signal to reduce the current SPL in the ear canal of the user between a second SPL range at a frequency within the frequency range.

The above summary does not include an exhaustive list of all aspects of the disclosure. It is contemplated that the disclosure includes all systems and methods that can be practiced from all suitable combinations of the various aspects summarized above, as well as those disclosed in the Detailed Description below and particularly pointed out in the claims. Such combinations may have particular advantages not specifically recited in the above summary.

BRIEF DESCRIPTION OF THE DRAWINGS

The aspects are illustrated by way of example and not by way of limitation in the figures of the accompanying drawings in which like references indicate similar elements. It should be noted that references to "an" or "one" aspect of this disclosure are not necessarily to the same aspect, and they mean at least one. Also, in the interest of conciseness and reducing the total number of figures, a given figure may be used to illustrate the features of more than one aspect, and not all elements in the figure may be required for a given aspect.

DETAILED DESCRIPTION

Figure 1:
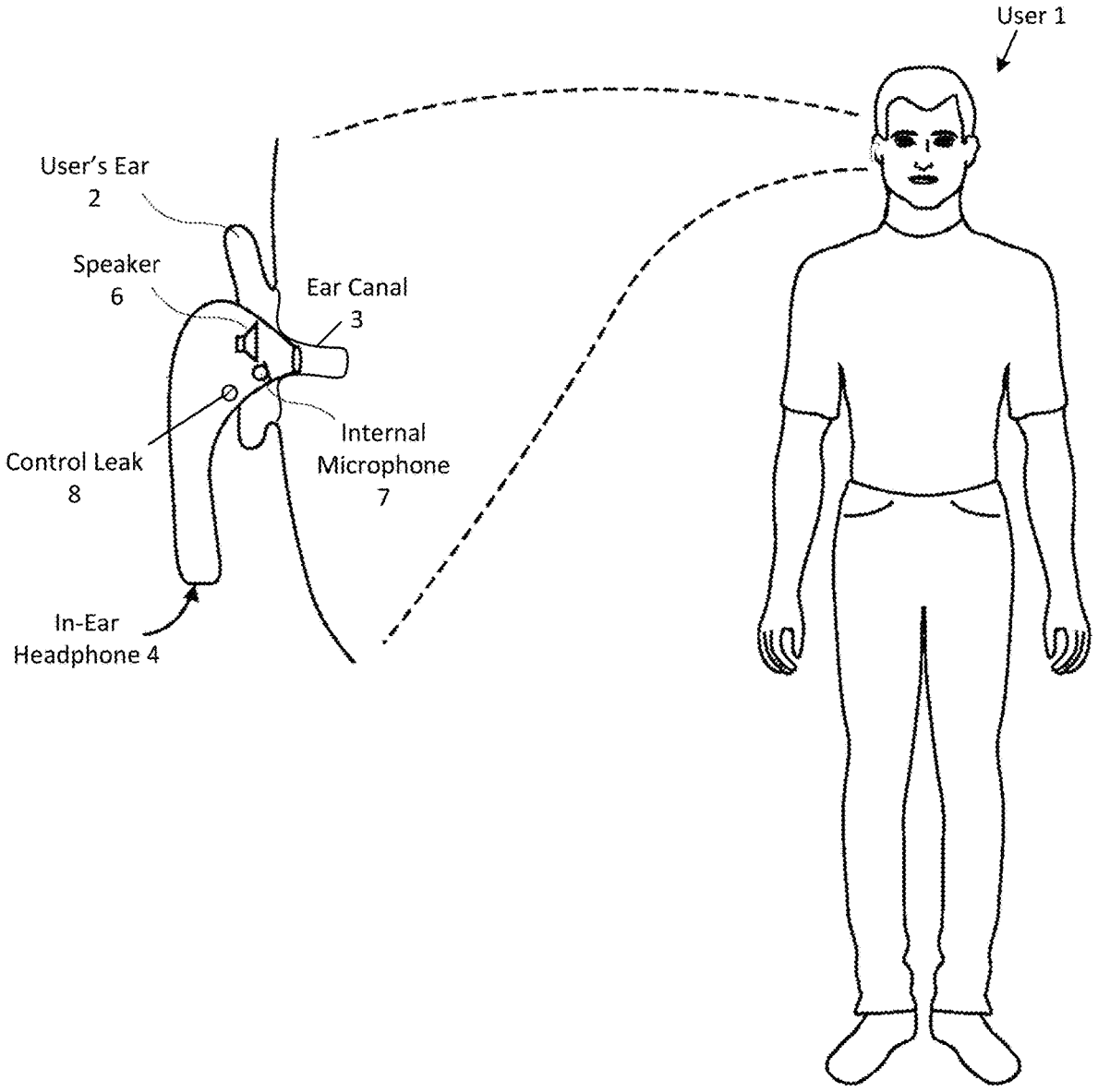
FIG. 1 shows a user wearing an in-ear headphone according to one aspect of the disclosure.

Several aspects of the disclosure with reference to the appended drawings are now explained. Whenever the shapes, relative positions and other aspects of the parts described in a given aspect are not explicitly defined, the scope of the disclosure here is not limited only to the parts shown, which are meant merely for the purpose of illustration. Also, while numerous details are set forth, it is understood that some aspects may be practiced without these details. In other instances, well-known circuits, structures, and techniques have not been shown in detail so as not to obscure the understanding of this description. Furthermore, unless the meaning is clearly to the contrary, all ranges set forth herein are deemed to be inclusive of each range's endpoints.

Users of in-ear audio devices which when worn acoustically seal the ear canal of the user, such as in-ear headphones and hearing aids, may experience an occlusion effect that causes the user to perceive "hollow" or "booming" echo-like sounds of their own voice. Compared to a completely open ear canal, the occlusion effect may increase low-frequency spectral content (e.g., below 2000 Hz) of sound pressure within the ear canal by about 30 dB. One way to effectively reduce the occlusion effect is to not completely seal the ear canal. To do this, manufacturers of in-ear headphones and hearing aids reduce the occlusion effect by including a "pressure" vent in the in-ear audio device that allows air within the ear canal to escape into the ambient environment in order to alleviate the sound pressure within the ear canal. Pressure vents, however, may reduce the benefit of passive attenuation due to the sealing nature of the in-ear audio devices. In addition, the effectiveness of pressure vents may vary between users. For example, the occlusion effect may be different between users, due to differences (e.g., shape and size) in ear canals between the users. As a result, pressure vents, which are static holes (which are not adjustable), may aid in reducing the effect of occlusion in some people but not others.

To overcome these deficiencies, the present disclosure describes an in-ear headphone that uses a combination of a control leak and a feedback acoustic noise cancellation (ANC) function to efficiently reduce the occlusion effect. The in-ear headphone includes a speaker, an internal microphone, and a control leak from the in-ear headphone into an ambient environment. The internal microphone produces a microphone signal that indicates a current sound pressure level (SPL or in-ear SPL) in an ear canal of a user due to the occlusion effect that is caused by the in-ear headphone being inserted into the ear canal. The current SPL is a result of the control leak that reduces a SPL in the ear canal within a first SPL range at a frequency within a frequency range than if otherwise not present. In other words, if the in-ear headphone fully acoustically sealed the ear canal, in which the in-ear headphone does not include the control leak (or the control leak is blocked) the SPL would be higher than the current SPL. Using the microphone signal, an ANC filter is determined and used to produce an anti-noise signal, which when used to drive the speaker reduces the current SPL in the ear canal of the user within a second SPL range at the frequency within the frequency range. As a result, the combination of the control leak and the ANC filter (which may be adapted to the user's ear canal) minimizes the sound pressure in the ear canal, thereby reducing the occlusion effect.

FIG. 1 shows a user 1 wearing an in-ear headphone 4, in which the systems and methods for digital audio signal processing described herein may be implemented according to one aspect. The headphone 4 shown is an in-ear headphone (or earbud) which may be a sealing type that has a flexible ear tip that serves to acoustically seal off the entrance of the user's ear canal 3 from the ambient environment by blocking or occluding in the ear canal (thereby achieving strong passive ambient sound isolation). The headphone 4 may be one of two headphones (left and right) that make up a headset. The methods described below may be implemented in one or both of the headphones that make up a headset. Alternatives (not shown) to the sealing type in-ear headphone include a closed back, on-the-ear headphone or an over-the-ear headphone that also creates a strong, passive ambient sound barrier. In both instances, a pocket of air is trapped at least partly within the ear, e.g., due to occlusion or blockage of the ear canal in the case of a sealing-type in-ear headphone.

The in-ear headphone 4 has an against-the-ear acoustic transducer or speaker 6 arranged and configured to reproduce sound that is represented in an audio signal directly into the ear canal 3 of the user 1. The headphone 4 also includes a control leak 8 that may have one or more ports that are configured to allow an air path from the in-ear headphone into the ambient environment. More about the control leak is described in FIG. 2. The headphone 4 also includes an internal microphone, which may be arranged and configured to directly receive the sound reproduced by the speaker 6. The headphone is configured to acoustically couple the internal microphone to a trapped volume of air within the ear that is being blocked by the headphone. In one aspect, along with the transducers and the electronics that process and produce the transducer signals (output microphone signals and an output audio signal to drive the speaker), there is also electronics that is integrated in the headphone housing (which is not illustrated). Such electronics may include an audio amplifier to drive the speaker with an audio signal (that may include program audio), a microphone sensing circuit or amplifier that receives the microphone signals and converts them into a desired format for digital audio signal processing, and a processor or controller (such as controller 31 of FIG. 3) and associated memory), where the memory stores instructions for configuring or programming the processor (e.g., instructions to be executed by the processor) to perform digital audio signal processing methods as described herein in detail.

In one aspect, an output audio signal or playback signal that may contain program audio such as music, podcast, or the voice of a far-end user during a voice communication session (e.g., phone call) can be provided along with other signals (such as an anti-noise signal produced by an ANC function) to drive the speaker, either separately or at least partially contemporaneously. The playback signal may be provided, via a network interface (such as the interface 32 of FIG. 3) from an external, companion audio source device (not shown) such as a smart phone or a tablet computer or over a wireless network.

Figure 2:
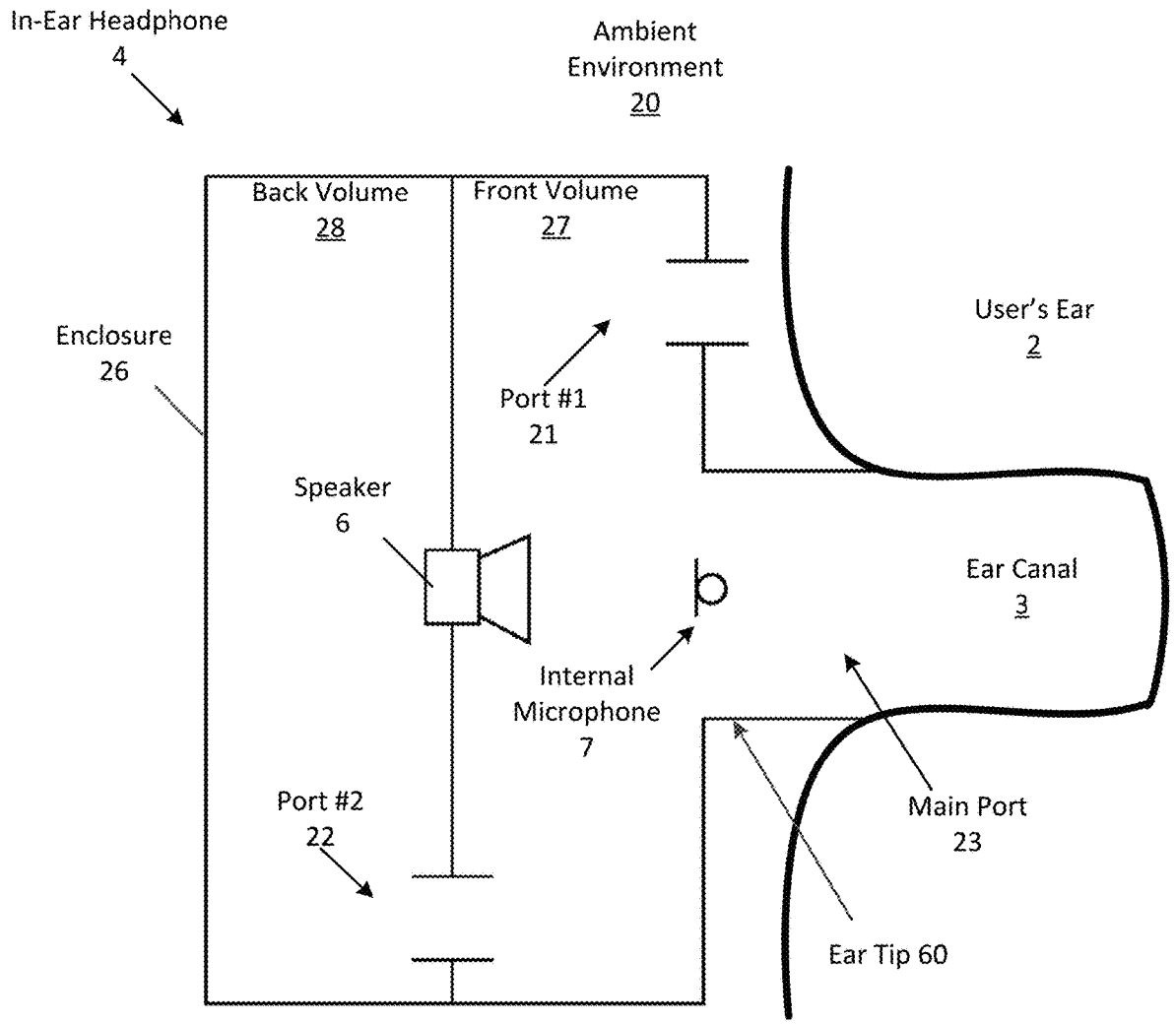
FIG. 2 illustrates a control leak of the in-ear headphone according to one aspect.

FIG. 2 illustrates a control leak of the in-ear headphones 4 according to one aspect. As described herein, a "control leak" may include one or more ports (or openings) that allow one or more paths between the in-ear headphone and the ambient environment 20. In other words, the path may allow air to traverse between the in-ear headphone (or the ear canal 3) and the ambient environment 20. As illustrated, the in-ear headphone 4 is inserted into the ear canal 3 of the user's ear 2, and is therein in a use state (e.g., a state in which an output audio signal may be outputted through the speaker 6 and/or the ANC function may be activated to produce anti-noise). Specifically, the in-ear headphone 4 includes an ear tip 60 that is inserted into the ear canal 3 of the user's ear 2. As described herein, the tip provides an acoustic seal that prevents sound (or air) from escaping from the ear canal into the environment 20. In one aspect, the ear tip may be made of any material, such as hardened plastic or a flexible material, such as rubber.

The in-ear headphone has an enclosure 26 that includes a back volume 28 and a front volume 27. The front volume includes the internal microphone 7, and speaker 6 is positioned such that a portion of the speaker is positioned inside the back volume and another portion is positioned in the front volume. In one aspect, a partition (or wall) that separates the back volume from the front volume may be formed around the speaker 6. In another aspect, the speaker 6 may be fully inside either volume. The front volume includes a main port 23 that is configured to direct outputted sound by the speaker into the ear canal 3 of the user.

The enclosure also includes a first port 21 and a second port 22, where at least one of which make up the control leak. In one aspect, the ports may be openings of any shape, such as, for example, circular, square, or rectangular shaped. The first port allows a (first) path between the front volume and the ambient environment, while the second port allows a (second) path between the back volume, the front volume, and the ambient environment. In one aspect, the enclosure may not include the second port 22, thereby sealing off the back volume 28. In another aspect, the first port 21 may be positioned on the ear tip 60. In another aspect, there may be additional ports (e.g., a port that allows a path from the back volume into the ambient environment, without having to traverse through the front volume).

In one aspect, the ports reduce the occlusion effect by alleviating at least some of the air pressure within the ear canal 3 by not allowing the in-ear headphone to make a complete seal (thereby containing a trapped pocket of air)

when the headphone is inside the user's ear canal. In particular, the ports (either separate or a combination thereof) may reduce the in-ear SPL of the ear canal within a first range at a frequency within a frequency range. In another aspect, the ports may be sized such that they are smaller than the main port. For example, the main port may be circular shaped and have a diameter at least twice the size of either port. Specifically, the main port may have a diameter 2-7 mm, whereas the ports may have a diameter of 1-3 mm. As another example, the ports may have different shapes with respect to the main port, such as being rectangular shaped. In that case, the main port may have a cross-sectional area that is at least twice a cross-sectional area of either port.

Figure 3:
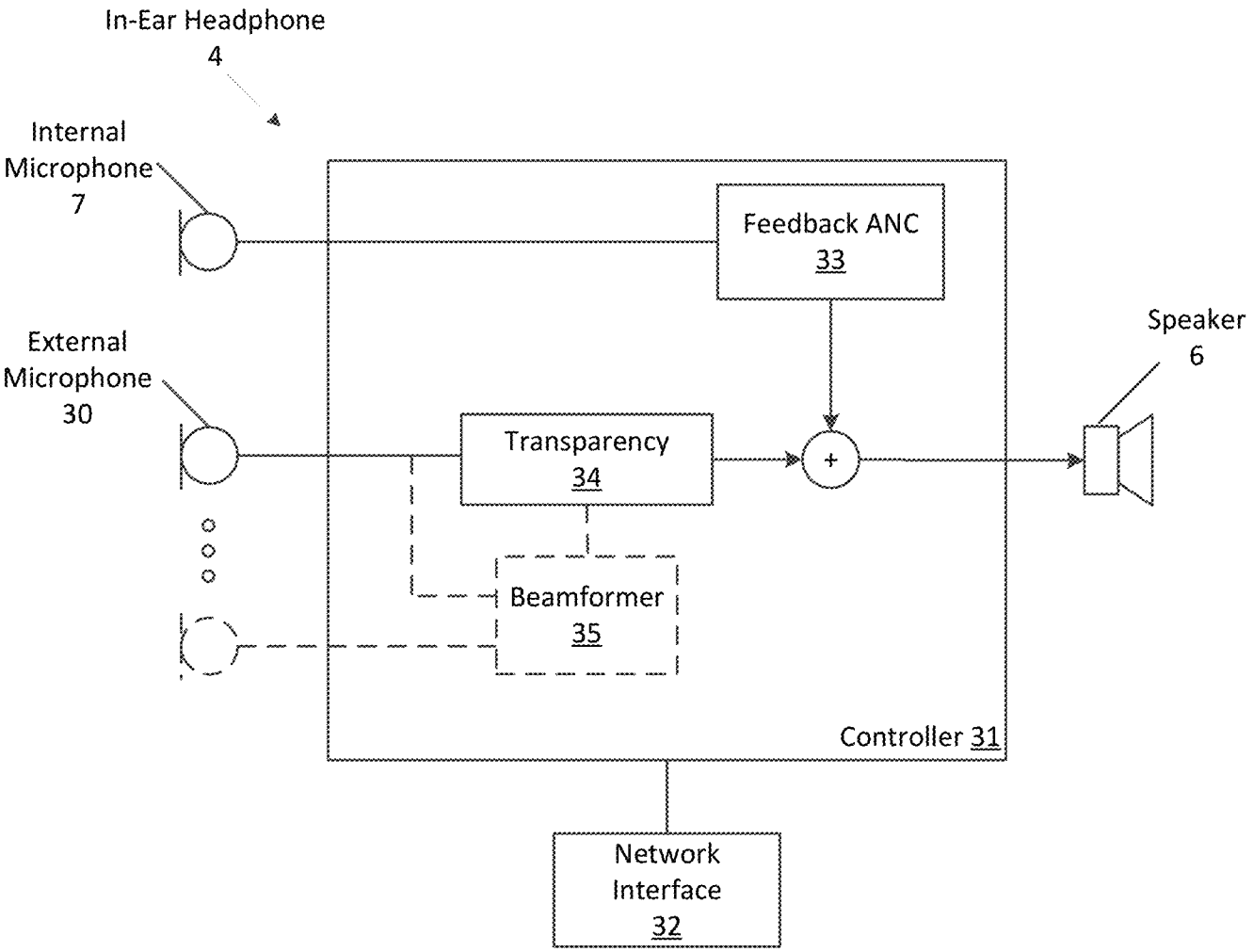
FIG. 3 is a block diagram of the in-ear headphone with the control leak and a feedback acoustic noise cancellation (ANC) function for reducing an in-ear sound pressure level (SPL) according to one aspect.

FIG. 3 is a block diagram of the in-ear headphone 4 with the control leak and feedback ANC for reducing an in-ear SPL according to one aspect. The headphone 4 includes the internal microphone 7, the speaker 6, an external microphone 30, a controller 31, and a network interface 32. As opposed to the internal microphone 7 that is configured to directly receive the sound reproduced by the speaker 7 and/or determine (or measure) the in-ear SPL in the ear canal, the external microphone is arranged and configured to receive ambient sound directly from the ambient environment. The headphone is configured to acoustically couple the external microphone to the ambient environment of the headphone. In one variation, as integrated in the headphone and worn by its user, the external microphone 30 may be more sensitive than the internal microphone 7 to a far-field sound source outside of the headphone. Viewed another way, as integrated in the headphone and worn by its user, the external microphone may be less sensitive than the internal microphone 7 to sound within the user's ear. Here it should be noted that while this figure shows a single microphone symbol (external microphone 30 and internal microphone 7), as producing a sound pickup channel (or microphone signal), persons skilled in the art will appreciate that the sound pickup channel may be produced by more than one microphone. In some instances, the sound pickup channel may be the result of combining multiple microphone signals, e.g., by a beamforming process, as described herein.

In one aspect each of these elements (or components) of the in-ear headphone may be integrated into the (e.g., enclosure of the) headphone 4. In another aspect, the headphone may include more (or less) elements as described herein. For instance, the in-ear headphone may include two or more speakers, two or more (external and/or internal) microphones, and/or a display screen that is configured to display image data.

The controller 31 may be a special-purpose processor such as an application-specific integrated circuit (ASIC), a general purpose microprocessor, a field-programmable gate array (FPGA), a digital signal controller, or a set of hardware logic structures (e.g., filters, arithmetic logic units, and dedicated state machines). The controller is configured to perform feedback ANC operations in order to reduce the occlusion effect in the user's ear canal. In addition, the controller is configured to perform networking operations and/or perform a transparency function. Also, the controller may optionally be configured to perform beamforming processes. In one aspect, although illustrated as being separate, (at least a portion of) the network interface 32 may be a part of the controller 31. More about how the controller performs these operations is described herein.

As described herein, the headphone 4 may be a wireless electronic device that is configured to establish a wireless communication data link via the network interface 32 with another electronic device over a wireless computer network (e.g., a wireless personal area network (WPAN)) using e.g., BLUETOOTH protocol or a WLAN in order to exchange data. In one aspect, the network interface 32 is configured to establish a wireless communication data link with a wireless access point in order to exchange data with a remote electronic server (e.g., over the internet). For example, the headphone may retrieve program audio for playback through the speaker 6 from a server. In another aspect, the network interface 32 may be configured to establish a communication data link via a mobile voice/data network that employs any type of wireless telecom protocol (e.g., a 4G Long Term Evolution (LTE) network).

In one aspect, the headphone 4 may be a part of an audio system that is configured to perform ANC operations or functions as described herein. In another aspect, the audio system may include a separate (e.g., companion) device, such as a smart phone, with which the headphone establishes a (e.g., wired and/or wireless) connection in order to pair both devices together. In one aspect, the (e.g., programmed processor of the) companion device may perform one or more of the operations described herein. For instance, the companion device may obtain program audio from a remote source and transmit the audio to the headphone for playback. In another aspect, at least some of the elements of the headphone may be a part of the companion device (or another electronic device) within the system, such as one or more external microphones.

The controller 31 may have one or more operational blocks, which may include a feedback ANC function 33, a transparency 34, and a beamformer 35. The feedback ANC function is configured to cause the speaker 6 of the headphone to produce anti-noise in order to minimize the occlusion effect. Specifically, the feedback ANC 33 receives a microphone signal from the internal microphone 7 and determines (or selects) an ANC filter based on the microphone signal. The ANC 33 may determine the filter such that an anti-noise signal produced using the filter reduces (when outputted by the speaker 6) the in-ear SPL in order to further minimize the occlusion effect. Specifically, the ANC 33 determines the filter such that when a corresponding anti-noise signal is used to drive the speaker, the current in-ear SPL is reduced. For instance, the microphone signal may indicate the (current) in-ear SPL. From the signal, the ANC 33 may select a filter such that the in-ear SPL is reduced within a second SPL range at a frequency within a frequency range when the anti-noise signal is outputted by the speaker. In one aspect, the frequency and/or frequency range may be the same (or different) to the frequency and/or frequency range within which the control leak reduces the in-ear SPL within the first SPL range as described herein.

In one aspect, the feedback ANC may determine the ANC filter based on multiple microphone signals. In particular, the feedback ANC may determine which ANC filter should be used based on differences between an in-ear SPL and an ambient SPL of the ambient environment. For instance, the feedback ANC may receive the microphone signal form the internal microphone 7 and a microphone signal from the external microphone 30. The ANC may determine the in-ear SPL based on the differences between both microphone signals.

The beamformer 35 is configured to process two or more microphone signals that are produced and received from two or more external microphones to form at least one directional beam pattern in a particular direction, so as to be more sensitive to a sound source that is located within the ambient environment, such as the user's mouth. As a result, the beamformer may produce at least one sound pickup beamformer output signal that includes one or more directional beam patterns that are aimed towards the sound source.

The transparency function 34 is configured to receive a microphone signal produced by the external microphone 30 (or a beamformer output signal produced by the beamformer 35) that includes ambient sounds of the ambient environment and configured to render the signal to cause the speaker 6 to reproduce the ambient sounds. Specifically, this function enables the user of the headphone to hear the ambient sounds within the environment more clearly, and preferably in a manner that is "transparent" as possible, e.g., as if the headphone was not being worn by the user. To do this, the controller 31 obtains the microphone signal, which includes one or more ambient sounds, and processes (or filters) the signal through a transparency filter to produce one or more filtered signals that includes at least a portion of the ambient sound. In one aspect, the transparency filter may reduce acoustic occlusion due to the headphones being in, on or over the user's ear, while also preserving spatial filtering effect of the user's anatomical features (e.g., head, pinna, shoulder, etc.). The filter may also help preserve the timbre and spatial cues associate with the actual ambient sound. Thus, in one aspect the transparency filter may be user specific, according to specific measurements of the user's head. For instance, the controller may determine the transparency filter according to a HRTF or equivalently, head related impulse response (HRIR) that is based on the user's anthropometrics. In one aspect, when the headphone has several microphones, a specific (or general) transparency filter may be applied to microphones signals produced by each of the microphones, and resulting filtered signals may be combined or summed together.

In one aspect, the controller 31 is configured to combine the anti-noise signal produced by the feedback ANC 33 and the filtered signal produced by the transparency 34 in order to drive the speaker 6 with both signals. In another aspect, the controller 31 may be configured to perform operations of any of the operational blocks described herein separately. For instance, the controller may only output the anti-noise signal, without the filtered signal, and vice a versa. In some aspects, this configuration may be based on user input (e.g., received by a companion device that transmits control signals to the controller via the network interface). For example, the user may indicate (via a user-interface of the companion device) that only feedback ANC is to be activated. As a result, the companion device is configured to instruct the controller 31 to only activate the feedback ANC 33.

Figure 4:
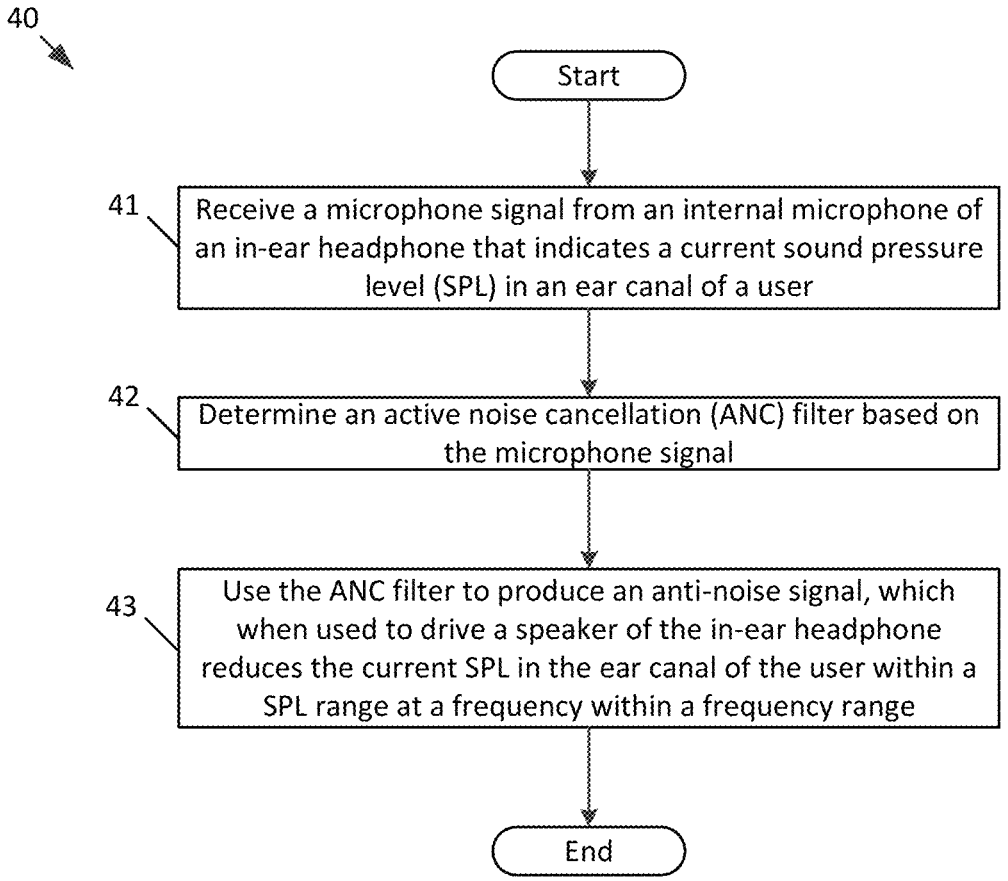
FIG. 4 is a flowchart of one aspect of a process to tune a feedback ANC function.

FIG. 4 is a flowchart of one aspect of a process 40 to tune a feedback ANC function. In one aspect, the process 40 is performed by (e.g., the controller 31 of) the in-ear headphone 4, which includes a control leak 8. Thus, this process will be described with reference to FIGS. 1 and 3. The process 40 begins by the controller 31 receiving a microphone signal from an internal microphone 7 of the in-ear headphone that indicates a current in-ear SPL of an ear canal of a user who is wearing the in-ear headphone (at block 41). The controller determines an ANC filter based on the microphone signal (at block 42). As described herein, the feedback ANC 33 may determine the filter in order to reduce the current in-ear SPL. The controller uses the ANC filter to produce an anti-noise signal, which when used to drive the speaker 6 reduces the current in-ear SPL within an in-ear SPL range at a frequency within a frequency range (at block 43). Specifically, the controller generates the anti-noise signal using the ANC filter, and drives the speaker using the anti-noise signal to reduce the current SPL, as described herein. In one aspect, driving the speaker using the anti-noise signal reduces the current SPL in the ear canal of the user by as much as 25 dB at a frequency within the frequency range, as described herein.

Some aspects perform variations of the process 40 described in FIG. 4. For example, the specific operations of at least some of the processes may not be performed in the exact order shown and described. The specific operations may not be performed in one continuous series of operations and different specific operations may be performed in different aspects. In one aspect, at least some of the operations of the process 40 may be performed by a machine learning algorithm that is configured to minimize the occlusion effect by reducing in-ear SPL, while the in-ear headphone is in use. In another aspect, the machine learning algorithm may include one or more neural networks (e.g., convolution neural networks, recurrent neural networks, etc.) that are configured to obtain a microphone signal from the internal microphone and determine which ANC filter is best suited (or most optimal) for a particular user in order to reduce in-ear SPL (e.g., to as close to 0 dB as possible).

In one aspect, the process 40 may be performed periodically (e.g., once every second, etc.) in order to adaptively configure the ANC filter. In another aspect, the process may be performed in response to sounds detected within the environment and/or actions performed by the user. For instance, the ANC filter may be determined in response to the headphone detecting footfall, or the action in which the user puts a food down while walking. In one aspect, such an action may be detected based on sensor data (e.g., from an onboard accelerometer).

Figure 5:
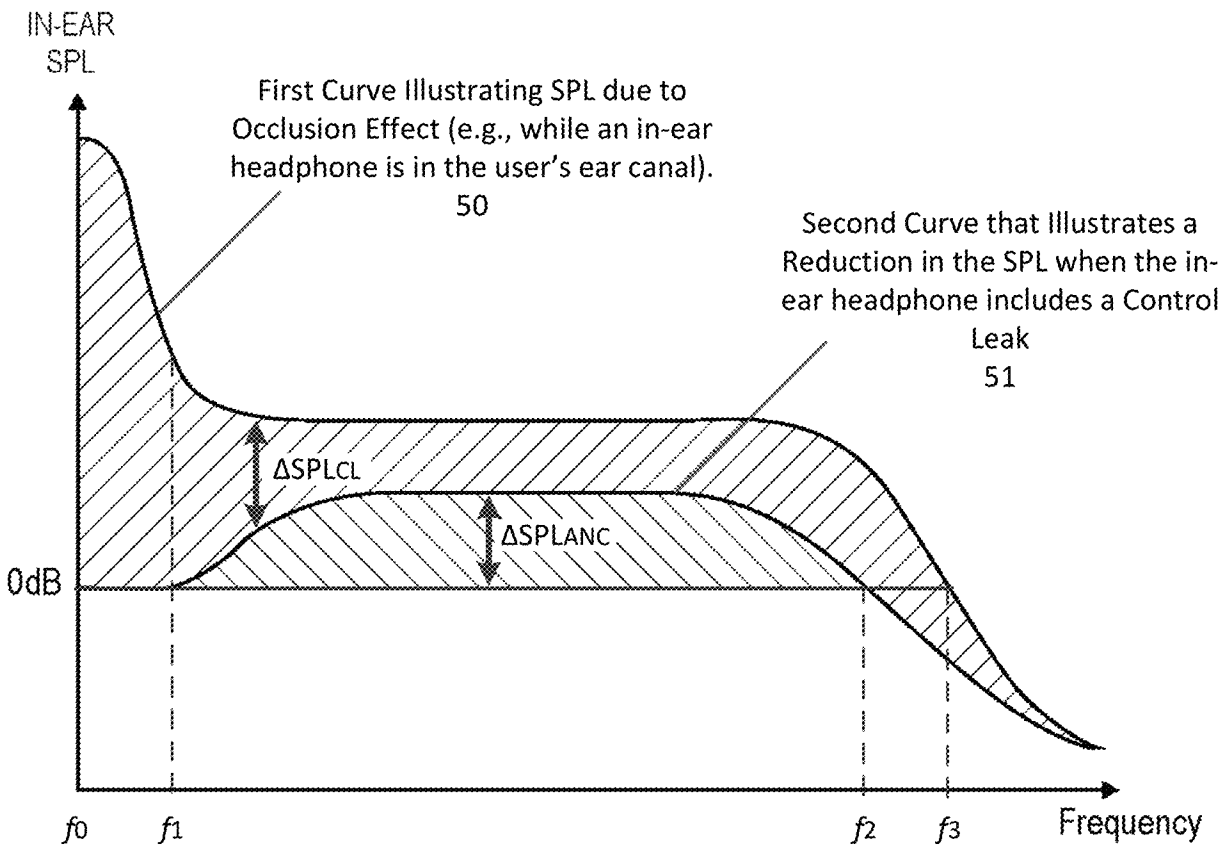
FIG. 5 shows differences to the in-ear SPL due to the presence of the control leak and the activation of the feedback ANC function according to one aspect.

FIG. 5 shows differences to the in-ear SPL due to the presence of the control leak and the activation of the feedback ANC function according to one aspect. Specifically, illustrates two SPL curves (with respect to frequency). The first curve 50 illustrates in-ear SPL due to the occlusion effect that is caused by an in-ear headphone, which creates a seal while inside the user's ear canal. Viewed another way, this curve 50 illustrates the in-ear SPL due to a headphone that does not include a control leak, such as control leak 8, or has a control leak that is (at least partially) blocked. The second curve 51 illustrates a reduction of the in-ear SPL when the in-ear headphone includes a control leak (or has a control leak that is not blocked), such as the in-ear headphone 4. In one aspect, this drop may be based on several factors, such as the particular user's anthropometrics (e.g., size and shape of the ear canal) and the size of the control leak. As illustrated, there is a change in the in-ear SPL, $\Delta SPL_{CL}$ (first SPL range), between curve 50 and 51, that is due to the control leak. In one aspect, the reduction in the in-ear SPL may be frequency dependent. In particular, between $f_0$ and $f_1$, the in-ear SPL due to the occlusion effect drops to approximately 0 dB. In one aspect, the $\Delta SPL_{CL}$ within this frequency range may be between 15-35 dB, where $f_1$ may be between 5-30 Hz. At higher frequencies, however, the drop of in-ear SPL may be less dramatic. For instance, between $f_1$ and $f_3$, the in-ear SPL due to the occlusion effect drops to a magnitude greater than zero, where $f_3$ may be a frequency between 1500-2500 Hz. In one aspect, $\Delta SPL_{CL}$ within this frequency range may be between 2-25 dB. In one aspect, these changes may be at one or more frequencies (or frequency bands) within the above-mentioned frequency range(s), or may be a change throughout the entire frequency range.

In order to further reduce the in-ear SPL, the in-ear headphone may implement feedback ANC, as described herein. As a result, to the activation of the feedback ANC (e.g., driving the speaker 6 with an anti-noise signal), there is another change in the in-ear SPL, $\Delta SPL_{ANC}$ (second SPL range). The effect of the feedback ANC may compensate (or reduce) the occlusion effect within frequencies in which the control leak does not effectively reduce the in-ear SPL $f_1$ and may extend to $f_2$, where $f_2$ may be a frequency that is less than $f_3$. In one aspect, $f_2$ may be a frequency between 1000-1400 Hz. In another aspect, $f_2$ may be a frequency between 800-1200 Hz. In another aspect, the reduction of in-ear SPL may extend to h. In other words, $\Delta SPL_{CL}$ may not reduce the in-ear SPL to approximately 0 dB between $f_2$ and $f_3$. In that case, $\Delta SPL_{ANC}$ may compensate. In one aspect, $\Delta SPL_{ANC}$ may be as much as 25 dB at a given frequency between $f_1$ and $f_2$ (or $f_1$ and $f_3$).

Personal information that is to be used should follow practices and privacy policies that are normally recognized as meeting (and/or exceeding) governmental and/or industry requirements to maintain privacy of users. For instance, any information should be managed so as to reduce risks of unauthorized or unintentional access or use, and the users should be informed clearly of the nature of any authorized use.

As previously explained, an aspect of the disclosure may be a non-transitory machine-readable medium (such as microelectronic memory) having stored thereon instructions, which program one or more data processing components (generically referred to here as a "processor") to perform the network operations and audio signal processing operations described herein, such as feedback ANC operations, transparency operations, and beamforming operations. In other aspects, some of these operations might be performed by specific hardware components that contain hardwired logic. Those operations might alternatively be performed by any combination of programmed data processing components and fixed hardwired circuit components.

While certain aspects have been described and shown in the accompanying drawings, it is to be understood that such aspects are merely illustrative of and not restrictive on the broad disclosure, and that the disclosure is not limited to the specific constructions and arrangements shown and described, since various other modifications may occur to those of ordinary skill in the art. The description is thus to be regarded as illustrative instead of limiting.

In some aspects, this disclosure may include the language, for example, "at least one of [element A] and [element B]." This language may refer to one or more of the elements. For example, "at least one of A and B" may refer to "A," "B," or "A and B." Specifically, "at least one of A and B" may refer to "at least one of A and at least one of B," or "at least of either A or B." In some aspects, this disclosure may include the language, for example, "[element A], [element B], and/or [element C]." This language may refer to either of the elements or any combination thereof. For instance, "A, B, and/or C" may refer to "A," "B," "C," "A and B," "A and C," "B and C," or "A, B, and C."

What is claimed is:

1. A method performed by an in-ear headphone that includes a speaker and an internal microphone, the method comprising:

receiving a microphone signal from the internal microphone that indicates a current sound pressure level (SPL) in an ear canal of a user, wherein the current SPL is a result of an opening that extends through an enclosure of the in-ear headphone such that an inside portion of the enclosure directly connects to an ambient environment outside the enclosure, thereby reducing a SPL in the ear canal;

determining an active noise cancellation (ANC) filter based on the microphone signal; and generating an anti-noise signal using the ANC filter; and driving the speaker using the anti-noise signal to reduce the current SPL in the ear canal of the user by as much as 25 dB at a frequency within a frequency range.

2. The method of claim 1, wherein the frequency range is 20 Hz-1200 Hz.

3. The method of claim 1, wherein the opening reduces the SPL in the ear canal to zero below 20 Hz.

4. The method of claim 1, wherein the enclosure includes a front volume and a back volume, wherein the opening is a port that allows a path between the front volume and the ambient environment.

5. The method of claim 4, wherein the port is a first port and the path is a first path, wherein the in-ear headphone further comprises a second port that allows a second path between the back volume, the front volume, and the ambient environment.

6. The method of claim 1, wherein the enclosure also includes a main port that is configured to direct sound output by the speaker into the ear canal of the user, wherein the main port has a cross-sectional area that is at least twice a cross-sectional area of the opening.

7. The method of claim 1, wherein the microphone signal is a first microphone signal, wherein the in-ear headphone further comprises an external microphone, wherein the method further comprises receiving a second microphone signal from the external microphone that includes sound of the ambient environment; and generating a filtered audio signal that includes at least a portion of the sound of the ambient environment by filtering the second microphone signal with an acoustic transparency filter; and driving the speaker with the filtered audio signal and the anti-noise signal.

8. The method of claim 1, wherein the opening is positioned on an ear tip of the in-ear headphone.

9. An in-ear headphone comprising:

a speaker;

an internal microphone;

an enclosure that comprises the speaker and the internal microphone;

an opening that extends through the enclosure to directly connect an inside portion of the in-ear headphone to an ambient environment outside the enclosure;

a processor; and memory having instructions which when executed by the processor causes the in-ear headphone to receive a microphone signal from the internal microphone that indicates a current sound pressure level (SPL);

determine an active noise cancellation (ANC) filter based on the microphone signal; and generate an anti-noise signal using the ANC filter; and driving the speaker using the anti-noise signal to reduce the SPL in an ear canal of the user as much as 25 dB at a frequency within a frequency range.

10. The in-ear headphone of claim 9, wherein the frequency range is 20 Hz-1200 Hz.

11. The in-ear headphone of claim 9, wherein the opening reduces the SPL in the ear canal to zero below 20 Hz.

12. The in-ear headphone of claim 9, wherein the enclosure includes a front volume and a back volume, wherein the opening is a port that allows a path between the front volume and the ambient environment.

13. The in-ear headphone of claim 12, wherein the port is a first port and the path is a first path, wherein the in-ear headphone further comprises a second port that allows a second path between the back volume, the front volume, and the ambient environment.

14. The in-ear headphone of claim 9, wherein the enclosure further comprises a main port that is configured to direct sound output by the speaker into the ear canal of the user, wherein the main port has a cross-sectional area that is at least twice a cross-sectional area of the opening.

15. The in-ear headphone of claim 9, wherein the microphone signal is a first microphone signal, wherein the in-ear headphone further comprises an external microphone, wherein the memory has further instructions to receive a second microphone signal from the external microphone that includes sound of an ambient environment;

generating a filtered audio signal that includes at least a portion of the sound of the ambient environment by filtering the second microphone signal with an acoustic transparency filter; and driving the speaker with the filtered audio signal and the anti-noise signal.

16. An article of manufacture comprising a non-transitory machine-readable medium having instructions stored therein that when executed by a processor of an in-ear headphone cause the headphone to receive, from an internal microphone of the in-ear headphone, a microphone signal that indicates a current sound pressure level (SPL) in an ear canal of a user, wherein the in-ear headphone comprises an opening that extends through an enclosure of the in-ear headphone such that an inside portion of the enclosure directly connects to an ambient environment that is outside the enclosure, thereby reducing a SPL in the ear canal;

determine an active noise cancellation (ANC) filter based on the microphone signal; and generate an anti-noise signal using the ANC filter;

driving a speaker of the in-ear headphone using the anti-noise signal to reduce the current SPL in the ear canal of the user as much as 25 dB at a frequency within a frequency range.

17. The article of manufacture of claim 16, wherein the frequency range is 20 Hz-1200 Hz.

18. The article of manufacture of claim 16, wherein the enclosure includes a front volume and a back volume, wherein the opening is a port that allows a path between the front volume and the ambient environment.

19. The article of manufacture of claim 18, wherein the port is a first port and the path is a first path, wherein the in-ear headphone further comprises a second port that allows a second path between the back volume, the front volume, and the ambient environment.

20. The article of manufacture of claim 16, wherein the enclosure also includes a main port that is configured to direct sound output by the speaker into the ear canal of the user, wherein the main port has a cross-sectional area that is at least twice a cross-sectional area of the opening.

21. The article of manufacture of claim 16, wherein the microphone signal is a first microphone signal, wherein the in-ear headphone further comprises an external microphone, wherein the non-transitory machine readable medium has further instructions to receive a second microphone signal from the external microphone that includes sound of the ambient environment;

generate a filtered audio signal that includes at least a portion of the sound of the ambient environment by filtering the second microphone signal with an acoustic transparency filter; and drive the speaker with the filtered audio signal and the anti-noise signal.

* * * * *